US005207800A

United States Patent [19]

Moore

[11] Patent Number: 5,207,800

[45] Date of Patent: May 4, 1993

[54] LOW TOXICITY, BIODEGRADABLE SALT SUBSTITUTE FOR DYEING TEXTILES: MAGNESIUM ACETATE IN DIRECT OR REACTIVE DYEING OF COTTON

[75] Inventor: Samuel B. Moore, Burlington, N.C.

[73] Assignee: Burlington Chemical Co., Inc., Burlington, N.C.

[21] Appl. No.: 772,482

[22] Filed: Oct. 7, 1991

[51] Int. Cl.[5] ..... C09B 62/80; C09B 67/80

[52] U.S. Cl. ..... 8/543; 8/532; 8/558; 8/594; 8/598; 8/599; 8/618; 8/680; 8/918

[58] Field of Search ..... 8/618, 543

[56] References Cited

U.S. PATENT DOCUMENTS 4,391,607 7/1983 Hildebrand ..... 8/549
4,547,196 10/1985 Balland ..... 8/496
4,826,503 5/1989 Lande ..... 8/543

*Primary Examiner*—A. Lionel Clingman
*Attorney, Agent, or Firm*—Rhodes, Coats & Bennett

[57] ABSTRACT

Low toxicity, biodegradable salt substitutes for use in dyeing of cotton and cotton blended fabrics. The salt substitutes are solubilized alkaline earth metal-organic complex compositions suitable to promote satisfactory dyeing. Preferably the composition is a mixture of magnesium acetate, magnesium citrate, and magnesium polyacrylate. After dyeing, a shift to alkaline pH in the wastewater treatment process allows for precipitation of the metal and the production of a biodegradable organic anion. The use of the salt compounds of the present invention in place of conventional sodium chloride or sulfate salts prevents the discharge of untreatable toxic wastewater into natural waterways.

5 Claims, No Drawings

LOW TOXICITY, BIODEGRADABLE SALT SUBSTITUTE FOR DYEING TEXTILES: MAGNESIUM ACETATE IN DIRECT OR REACTIVE DYEING OF COTTON

BACKGROUND OF THE INVENTION (1) Field of the Invention

The present invention relates generally to the dyeing of textiles and, more particularly, to low toxicity, biodegradable common salt substitutes for use in dyeing of cotton and cotton blended fabrics.

(2) Description of the Prior Art

Cellulose dyeing requires large quantities of common salts, e.g. sodium or potassium salts of mineral acids such as sodium chloride or sodium sulfate, as an aid in dyeing the fiber. The amount of salt may range from 5 up to 125% on weight of goods (OWG). Recently, it has been determined that the sodium and the chloride and/or sulfate content of textile wastewater can be a primary source of pass-through aquatic toxicity in industrial and municipal discharge of treated wastewater. This is because there is no known commercially viable process to remove the dissolved salts from the treated water prior to returning the treated wastewater to the natural waterway. In North Carolina alone, 40% of all wastewater is from textile mills. As a result the amount of salt water being continually discharged into the natural, fresh water receiving streams is increasing. Unfortunately, most fresh water organisms find salt toxic over certain concentrations.

Alkaline earth salts, such as magnesium carbonate, offer an alternative to sodium salts for textile dyeing. This is because the alkaline earth salts are lower solubility compounds compared to sodium chloride or sodium sulfate and, due to their chemical nature, can be removed by precipitation during treatment of wastewater from the dyeing process. The solubility of the alkaline earth salts can be further reduced by increasing wastewater pH, resulting in the formation of alkaline earth hydroxides.

A comparison of the solubility of sodium and magnesium compounds in water at 20 degrees C can be summarized as follows:

Sodium Chloride: >350 g/1
Sodium Sulfate: >275 g/1
Magnesium Sulfate: 71 g/1
Magnesium Acetate: >100 g/1
Magnesium Carbonate Hydroxide: Insoluble Unfortunately, most alkaline earth salts also usually precipitate under neutral or slightly alkaline conditions and can cause severe hard water deposits. Thus, the use of these non-sodium, potassium and ammonium compounds has been limited to the acidic conditions found during the rinsing or after fixation steps in the dyeing process.

For example, it has been known for some time that alkaline earth salts can act as a dyestuff antimigrants in textile dyeing. One such compound is sold by ICI America under the tradename DRILEV JH for the prevention of migration in direct dyeing. DRILEV is a solution of magnesium acetate with about 10% excess acetic acid. However, there has been no suggestion of using DRILEV as a salt substitute. Furthermore, the recommended use pH for DRILEV is about 3.0 to 5.0 which is too low for satisfactory dyeings.

In order to be commercially acceptable, a salt substitute must be easy to use in place of conventional salts.

Accordingly, the salt replacement must exhibit long term storage stability and dye satisfactory at any conventional operational dyebath pH. In addition, the salt should not precipitate at conventional dyebath concentrations or cause deposits on the goods. Thus, the useful pH range of the salt substitute needs to be from 5.5–12.0.

The alkaline pH stability of the product is also important when dyeing fiber reactive dyes, which are fixed or reacted with the cellulose under alkaline conditions. Direct dyes are fixed or exhausted under ambient pH conditions or slightly adjusted pH conditions which are not as severe as the alkaline conditions found in fiber reactive dyeing.

Thus, there remains a need for a low toxicity, biodegradable salt substitute for use in dyeing of cotton and cotton blended fabrics which is efficacious in the dyeing of cellulose fiber, non-toxic in the aquatic environment and can be precipitated to produce a biodegradable organic anion.

SUMMARY OF THE INVENTION

The present invention is directed to low toxicity, biodegradable salt substitutes for use in dyeing of cotton and cotton blended fabrics. The salt substitutes are solubilized alkaline earth metal-organic complex compositions suitable to promote satisfactory dyeing. Preferably the composition is a mixture of magnesium acetate, magnesium citrate, and magnesium polyacrylate. After dyeing, a shift to alkaline pH in the wastewater treatment process allows for precipitation of the metal and the production of a biodegradable organic anion. The use of the salt compounds of the present invention in place of conventional sodium chloride or sulfate salts prevents the discharge of untreatable toxic wastewater into natural waterways.

Accordingly, one aspect of the present invention is to provide an alkaline earth metal organic salt for replacing sodium salts or the like in direct or reactive dyeing of cotton and cotton blended fabrics.

Another aspect of the present invention is to provide a composition for replacing sodium salts or the like in direct or reactive dyeing of cotton and cotton blended fabrics. The composition includes: (a) about 3.5 to 10 wt. % magnesium oxide; (b) about 13.3 to 40 wt. % acetic acid; and (c) the balance water.

Still another aspect of the present invention is to provide a process for preparing a composition for replacing sodium salts or the like in direct or reactive dyeing of cotton and cotton blended fabrics. The process includes the steps of: (a) mixing water with up to about 13.3 wt. % citric acid to form a mixture; (b) adding about 13.3 to 40 wt. % acetic acid to the mixture while mixing; (c) adding about 3.5 to 10 wt. % magnesium oxide to the mixture while mixing; (d) adding up to about 13.3 wt. % polyacrylic acid to the mixture while mixing; and (e) cooling the mixture.

These and other aspects of the present invention will become apparent to those skilled in the art after a reading of the following description of the preferred embodiment.

DESCRIPTION OF THE PREFERRED EMBODIMENTS EXPERIMENTAL DESIGN

A centroid-simplex series of mixture experiments was devised, using magnesium salts as the mixture matrix. This type of experimental design is explained by Cornell, John A., *Experiments with Mixtures*, New York: John Wiley & Sons., 1981.

A linear organic anion was chosen due to its properties of high solubility and high biodegradability. Biodegradation data indicated that linear organic anions such as acetate and citrate are highly degradable (see e.g. Swisher, R. D., *Surfactant Biodegradation*, 2nd Edn, New York: Marcel Dekker, Inc. 1987).

Preparation

The initial mixtures were prepared by mixing water, magnesium oxide powder and the organic acid. One source of magnesium oxide is sold under the tradename Magox 98 HR by Premier Refractories and Chemicals of Cleveland, Ohio. The tank was first charged with water. The organic acid was then added while mixing. The magnesium oxide was then added slowly while mixing. Heat will be generated due to the exothermic reaction. The mixture is continued to be mixed for one hour. After mixing, the mixture is cooled and filtered through a one micron filter. Final pH of the mixtures were in the range of 3.0 to 5.0 depending on the acid concentration.

Shelf Stability Tests

Due to the low solubility of these salts, mixture stability is a real issue in the practical application of this alternative technology. Mixtures were considered acceptable when a minimum of 90 days shelf life displayed little or no sedimentation.

EXAMPLES 1-6

Shelf stability tests were run for 90 days at ambient temperatures and 30 days at 40° C. The balance of the mixtures was water. All measurements are in weight percent. The citric acid was a 50 wt. % solution. The following results were obtained:

TABLE 1

Shelf Stability Results

| Example No. | Organic Acid | MgO Level | pH | Observation |
|---|---|---|---|---|
| 1 | 40% acetic | 10% | 4.7 | good stability |
| 2 | 40% citric | 10% | 3.5 | poor stability |
| 3 | 20% acetic/ 20% citric | 10% | 4.2 | slight haze |
| 4 | 20% acetic/ 20% polyacrylic | 10% | 4.5 | slight haze |
| 5 | 20% citric/ 20% polyacrylic | 10% | 4.5 | poor stability |
| 6 | 13.3% acetic/ 13.3% citric/ 13.3% polyacrylic | 10% | 4.5 | slight haze |

The above examples illustrate that at MgO levels of 10%, at least between 13.3% and 40% acetic acid and between 0 and 26.7% other organic acid is necessary to provide a stable solution. Other tests showed that at these magnesium levels (10% MgO) precipitation occurred after two weeks storage at a pH of 6.5. However, at a pH of 3.0–4.0, stabilities were much improved and that similar magnesium values were possible (6–7% MgO). Over 200 mixtures were evaluated before reasonable stabilities were obtained.

Dye Yield Tests

Conventional direct dyeings of cotton fabrics were made to determine the dye yield of salt replacement mixtures having good stability.

EXAMPLES 7-15

100% cotton single knit fabric was dyed with Direct Black 22 to a depth of 3% OWG (on weight of goods). The balance of the mixtures was water. All measurements are in weight percent. The citric acid was a 50 wt. % solution. The following results were obtained:

TABLE 2

Dye Yield Results

| Example No. | Organic Acid | MgO Level | pH | Dye Yield |
|---|---|---|---|---|
| 7 | 40% acetic | 10% | 4.7 | good |
| 8 | 40% citric | 10% | 3.5 | marginal |
| 9 | 20% acetic/ 20% citric | 10% | 4.2 | good |
| 10 | 20% acetic/ 20% polyacrylic | 10% | 4.5 | good |
| 11 | 20% citric/ 20% polyacrylic | 10% | 4.5 | marginal |
| 12 | 13.3% acetic/ 13.3% citric/ 13.3% polyacrylic | 10% | 4.5 | good |
| 13 | 37% citric | 3.5% | 4.0 | poor |
| 14 | 13.3% acetic/ 13.3% citric/ 13.3% polyacrylic | 6% | 4.5 | good |
| 15 | 13.3% acetic/ 13.3% citric/ 13.3% polyacrylic | 5.4% | 4.5 | good |

The above examples illustrate that MgO levels of greater than about 3.5% and at least between 13.3% and acetic acid and between 0 and 26.7% other organic acid is necessary to provide acceptable dye yield.

Dyebath Compatibility Tests

In addition to dye yield it is also desirable that the salt substitutes not leave any significant residue on the dyed fabric. Residue would require an additional cleaning step. Since the pH of the dye bath can vary between 5.0 and 12.0 additional tests were conducted to measure whether the various salt substitutes were also stable under normal dyeing conditions.

Examples 16-24

A typical fiber reactive dyebath was set up as follows: 2.0 g/L Phosphated alcohol detergent; 0.2 g/L Dyebath lubricant; 20.0–100.0 g/L salt or salt replacement; pH adjusted from 4.0 to 12.0 with caustic soda liquid. Each solution was evaluated for clarity and precipitation from 25° C. up to 100° C. in rotation to simulate temperature shifts found in dyeing. The following results were obtained:

TABLE 3

Dyebath Compatibility Results

| Example No. | Organic Acid | MgO Level | pH | Compatibility |
|---|---|---|---|---|
| 16 | 40% acetic | 10% | 4.7 | poor |
| 17 | 40% citric | 10% | 3.5 | marginal |
| 18 | 20% acetic/ 20% citric | 10% | 4.2 | marginal |
| 19 | 20% acetic/ 20% polyacrylic | 10% | 4.5 | good |
| 20 | 20% citric/ 20% polyacrylic | 10% | 4.5 | good |
| 21 | 13.3% acetic/ 13.3% citric/ 13.3% polyacrylic | 10% | 4.5 | good |
| 22 | 37% citric | 3.5% | 4.0 | good |
| 23 | 13.3% acetic/ 13.3% citric/ 13.3% polyacrylic | 6% | 4.5 | good |
| 24 | 13.3% acetic/ 13.3% citric/ | 5.4% | 4.5 | good |

TABLE 3-continued

| Dyebath Compatibility Results | | | | |
|---|---|---|---|---|
| Example No. | Organic Acid | MgO Level | pH | Compatibility |
| | 13.3% polyacrylic | | | |

Poor dye compatibility was generally evidenced by precipitation on the goods. The above examples illustrate that acetic acid alone is not suitable unless the precipitate can be removed from the goods. However, the addition of citric and/or polyacrylic acid to the salt substitute produced acceptable dye compatibility.

It was expected that the salt replacement mixtures would be susceptible to cloudiness as the pH of the dyebath increased from a 7.0 to 12.0. This was to be expected as the magnesium complex converts at alkaline pH to magnesium carbonate and magnesium hydroxide. However, the mixtures containing citric acid precipitated as a colloidal particle, remained dispersed and did not precipitate onto the fabric. These dye compatibility studies demonstrate that with the correct formulation, stability can be achieved even under the alkaline conditions present in dyeing.

Preparation of the Preferred Embodiment

As shown by the above examples, acetic acid alone was not suitable unless the precipitate was removed from the goods. However, the addition of citric and/or polyacrylic acid to the salt substitute produced acceptable dye compatibility. Furthermore, the mixtures containing citric acid precipitated as a colloidal particle, remained dispersed and did not precipitate onto the fabric. Finally, the mixtures containing polyacrylic acid remained clear, more storage stable, and produced the lowest fabric residue. Thus, the most preferred embodiment was a mixture of each of these three organic acids.

The preferred salt replacement mixture was prepared by mixing water, magnesium oxide powder and the organic acids. One source of polyacrylic acid is sold under the tradename Aquatreat AR 900-A by ALCO Chemical Corporation of Chattanooga, Tenn. This is a 2000–3000 mwt acid polymer which is 50% active. In addition to the organic acids, up to about 3 wt. % of a 50% liquid naphthene sulfonic dispersant was added. One source of a dispersant is sold under the tradename Lomar PL by Henkle Corporation of Charlotte, N.C. Also, the final pH of the solution is adjusted with ammonium hydroxide (26%) to adjust the pH to 7.2 for dyebath compatibility. The preferred composition is as follows:

| | |
|---|---|
| Water | 56.5 wt % |
| Citric acid (50%) | 14.4 |
| Acetic acid, glacial | 5.4 |
| Polyacrylic acid | 13.5 |
| Magnesium oxide | 5.4 |
| Lomar PL | 3.0 |
| Ammonium hydroxide | 1.8 |

The tank is first charged with water. Citric acid is then added while mixing. Acetic acid is than added while mixing. The magnesium oxide was then added slowly while mixing. Heat will be generated due to the exothermic reaction. The mixture is mixed for an addition 15 minutes then the polyacrylic acid is added and mixing is continued for 5 minutes. The Lomar PL is then added and mixing is continued for one hour. After mixing, the mixture is cooled and the pH is adjusted to about 7.2 with ammonium hydroxide and filtered through a one micron or smaller filter.

Dyebath Tests

Different dyes may dye differently. Accordingly, a series of dyebath tests were conducted using various dye stuffs and fabrics. The following run procedure was used for the dyebath tests: Set bath with tetrasodium pyrophosphate, phosphated alcohol surfactant, Dye; Check pH; Heat to 212 deg. F; Add Salt or salt substitute; Check pH; and Run at Temperature for 30 minutes.

EXAMPLE 25

Initial dye testing was done with Direct Black 22, 3% OWG at a liquor ratio of 15:1. Dyeing were performed using equal amounts of the salt substitute. The dyeing were equal for shade and strength.

EXAMPLES 26–31

Secondary testing was done on cotton and nylon hosiery (80% cotton and 20% nylon) using the following direct dyes:

| | |
|---|---|
| Burco Direct Blue 16BLL | 0.5858% |
| Burco Direct Scarlet ASW | 0.4454% |
| Burco Direct Yellow DW | 0.7095% |
| Tetra Sodium Pyrophosphate | 1.0% |
| Burco C3F (Phosphated alcohol) | 2.0% |
| Salt or Salt replacement | 20, 15, 10% |

Dyeings were performed using equal amounts of the preferred embodiment of the salt substitute. The dyeing were equal for shade and strength. It appeared that all dyeings were level, although the direct dyes, especially the yellow, stained nylon worse when using the salt substitute. This would be expected since the salt substitute had a pH of 3.5–5.0, which could cause many direct dyes to stain nylon. The following results were obtained from the comparative dyeing trials (sodium chloride versus salt replacement):

TABLE 4

| Dyebath Results | | |
|---|---|---|
| Example No. | Composition | Observation |
| 26 | 20% NaCl | Good dyeing |
| 27 | 20% Subst. | Good dyeing |
| 28 | 15% NaCl | Good dyeing |
| 29 | 15% Subst. | Fair dyeing |
| 30 | 10% NaCl | Fair dyeing |
| 31 | 10% Subst. | Poor dyeing |

EXAMPLES 32–43

Additional dyeing were made with the preferred embodiment of the salt replacement and direct and reactive turquoise dyes. These dyeing, shown in Table 5 below, showed excellent performance in direct dyeing and problematic performance using Remazol type reactive dyes. Additional work continues with Procion (a trademark of ICI) and Cibacron (a trademark of Ciba-Gigy) reactive dyes.

TABLE 5

| Additional Dyebath Results | | | |
|---|---|---|---|
| Example No. | Composition | Dye type | Observation |
| 32 | 20% NaCl | Reactive | Weak - 20% |
| 33 | 40% NaCl | Reactive | Slightly Weak |
| 34 | 60% NaCl | Reactive | Good dyeing |

TABLE 5-continued

| Additional Dyebath Results | | | |
|---|---|---|---|
| Example No. | Composition | Dye type | Observation |
| 35 | 80% NaCl | Reactive | Good dyeing |
| 36 | 20% Subst. | Reactive | Weak - 60% |
| 37 | 40% Subst. | Reactive | Weak - 40% |
| 38 | 60% Subst. | Reactive | Weak - 20% |
| 39 | 80% Subst. | Reactive | Weak - 20% |
| 40 | 20% NaCl | Direct | Good dyeing |
| 41 | 40% NaCl | Direct | Good dyeing |
| 42 | 20% Subst. | Direct | Slightly Weak |
| 43 | 40% Subst. | Direct | Good dyeing |

Conductivity

The conductivities of the salt substitute mixture is an important factor versus the amount of the product needed to fix the direct dyestuff to the fiber. A comparison of the conductivity of sodium salts with the preferred embodiment of the salt replacement is shown below. Values are shown in umhos at 25° C. Parenthetic values are extrapolated from conductivity of stock solution.

TABLE 6

| Conductivity Results | | | |
|---|---|---|---|
| PPM | Magnesium Salt | Sodium Chloride | Sodium Sulfate |
| 1,000 | (113) | (1,755) | 1,627 |
| 1,500 | (170) | (2,632) | 2,273 |
| 2,000 | (227) | (3,510) | 2,992 |
| 2,500 | (284) | (4,388) | (3,071) |
| 3,000 | (340) | (5,265) | (3,686) |
| 4,000 | (454) | (7,020) | (4,914) |
| 10,000 | 1,134 | (17,550) | (12,285) |
| 20,000 | — | 35,100 | 24,570 |

A critical discovery was the fact that the preferred alkaline earth salts produced good dyeing at conductivity levels 1000 times lower than common salt (NaCl).

Aquatic Toxicity

One measure of the environmental impact of a chemical is its acute aquatic toxicity. Aquatic toxicity tests were performed on the preferred embodiment of the salt replacement and the sodium salts. The LC50 value of the present invention for Daphnia pulex is in excess of 4,000 mg/1. This can be compared to Sodium Chloride and Sodium Sulphate which have LC50 values around 2,500 mg/1.

TABLE 7

| 48-Hour LC50 Results | | |
|---|---|---|
| Magnesium Salt | Sodium Chloride | Sodium Sulfate |
| >4,000 ppm | 2,376 ppm | 2,766 ppm |

Biodegradation Studies

A second measure of the environmental impact of a chemical is its removal from the environment by biological action. Biodegradation tests were performed using the preferred embodiment of the salt substitute and two controls for comparison.

Biodegradation studies were performed using a Product Demand Analysis procedure. This procedure uses a 1.0 mg/300 ml volume of 100% active product to biodegrade in 5, 15, and 30 days. These oxygen uptake values are then ratioed verses the chemical oxygen demand (COD) to calculate a biodegradation rate. Two standards were concurrently run: Neodol 91.6, an alcohol ethoxylate surfactant that is highly degradable and Tergitol NP10, an alkyl phenol ethoxylate that has been found to degrade slowly and cause foaming problems. The following results were obtained:

TABLE 8

| Biodegradation Results | | | |
|---|---|---|---|
| Parameter | Magnesium Salt | TERGITOL NP-10 | NEODOL 91.6 |
| Solids (%) | 23 | 100 | 100 |
| Grams/L | 4.3478 | 1.0000 | 1.0000 |
| COD (mg/Kg) | 977,200 | 2,348,400 | 2,409,400 |
| BOD (mg/Kg) | | | |
| 5-Day | 431,300 | 431,300 | 704,000 |
| 15-Day | 486,900 | 709,100 | 1,320,200 |
| 30-Day | 602,000 | 1,177,800 | 1,799,000 |
| Degradability (%) | | | |
| 5-Day | 44 | 18 | 29 |
| 15-Day | 50 | 30 | 55 |
| 30-Day | 62 | 55 | 75 |

The results of this testing shows that the product is highly degradable, 50% in 15 days, and is very close to approaching the same degree of biodegradation rates as is seen with Neodol 91.6 (a trademark of Shell Chemical).

The above examples show that alkaline earth salts are a satisfactory substitute for sodium salt as the primary electrolyte for direct and reactive dyeing on hosiery, 100% cotton single knit, and polyester/cotton single knit fabrics. In addition, the preferred embodiment of the invention has demonstrated low acute aquatic toxicity and very high biodegradation rates.

Certain modifications and improvements will occur to those skilled in the art upon reading of the foregoing description. By way of example, amino, polyphosphate, gluconate, and polymeric chelating agents are possible substitutes for polyacrylic acid. Also, the composition of the present invention could be utilized as a source of soluble organic magnesium in such processes as emulsion polymerization, fertilizer, wastewater flocculation, textile bleaching, and chemical coagulation. It should be understood that all such modifications and improvements have been deleted herein for the sake of conciseness and readability but are properly within the scope of the following claims.

I claim:

1. A composition for replacing alkali salts in direct or reactive dyeing of cotton and cotton blended fabrics, said composition comprising:

(a) about 3.5 to 10 wt. % magnesium oxide;
(b) about 13.3 to 40 wt. % acetic acid;
(c) up to about 26.7 wt. % of another organic acid selected from the group including citric acid and polyacrylic acid; and
(d) the balance water.

2. The composition according to claim 1, further including up to about 13.3 wt. % of citric acid and up to about 13.3 wt. % of polyacrylic acid.

3. The composition according to claim 1, further including about 3 wt. % of an anionic dispersant.

4. A composition for replacing alkali salts in direct or reactive dyeing of cotton and cotton blended fabrics, said composition comprising:

(a) about 3.5 to 10 wt. % magnesium oxide;
(b) about 13.3 to 40 wt. % acetic acid;
(c) up to about 13.3 wt. % of citric acid;
(d) up to about 13.3 wt. % of polyacrylic acid; and
(e) the balance water.

5. The composition according to claim 4, further including about 3 wt. % of an anionic dispersant.

* * * * *